US006650239B1

(12) United States Patent
Hron

(10) Patent No.: US 6,650,239 B1
(45) Date of Patent: Nov. 18, 2003

(54) OUTDOOR INTRUSION DETECTION ALARM

(76) Inventor: Thomas George Hron, 4125 Aircraft Dr., Anchorage, AK (US) 99502

( * ) Notice: Subject to any disclaimer, the term of this patent is extended or adjusted under 35 U.S.C. 154(b) by 0 days.

(21) Appl. No.: 10/186,066

(22) Filed: Jun. 28, 2002

(51) Int. Cl.[7] ..... G08B 13/00

(52) U.S. Cl. ..... 340/541; 340/540; 340/573.1; 340/426; 340/533; 340/564; 340/565; 340/566

(58) Field of Search ..... 340/541, 540, 340/573.1, 426, 533, 564, 565, 566; 116/81, 83, 22

(56) References Cited

U.S. PATENT DOCUMENTS

| | | | | | |
|---|---|---|---|---|---|
| 1,434,132 | A | | 10/1922 | McDonald | |
| 1,633,361 | A | | 6/1927 | Bryant | |
| 3,071,104 | A | | 1/1963 | McCandlish | |
| 3,443,546 | A | | 5/1969 | Covey | |
| 3,831,162 | A | * | 8/1974 | Armstrong | 340/261 |
| 3,836,899 | A | * | 9/1974 | Duvall et al. | 340/261 |
| 4,064,825 | A | | 12/1977 | Sly | |
| 4,295,437 | A | * | 10/1981 | Mock, Jr. et al. | 116/202 |
| 4,591,834 | A | * | 5/1986 | Kyle | 340/566 |
| 5,463,595 | A | | 10/1995 | Rodhall | |
| 5,892,446 | A | | 4/1999 | Reich | |
| 6,118,375 | A | | 9/2000 | Duncan | |

* cited by examiner

*Primary Examiner*—Jeffery Hofsass
*Assistant Examiner*—Hung Nguyen

(57) ABSTRACT

An outdoor intrusion detection system that includes a portable housing (1), a plurality of adjustable fasteners (21) and (22), an augmented switch (5), and a sensor line (3) for sensing human and/or animal intrusions into a predetermined perimeter or boundary configuration, which can be variable in conformity with terrain and flora. A battery-powered high decibel piezo siren (7) activates when any intrusion occurs. The sensor line is released, retrieved, and stored on a reel that is an integral part of the housing, completing a lightweight alarm system that fits in a coat pocket or backpack pouch of a camper, hiker, or soldier. The system can also be used for protecting gardens and fruit trees, automobile and airplane displays, and comparable things.

5 Claims, 3 Drawing Sheets

OUTDOOR INTRUSION DETECTION ALARM

CROSS-REFERENCE TO RELATED APPLICATIONS

None

FEDERALLY SPONSORED RESEARCH

None

SEQUENCE LISTING OR PROGRAM

None

BACKGROUND OF THE INVENTION

1. Field of Endeavor

The present invention is an outdoor intrusion detection system, specifically a portable alarm that warns of human and animal incursions across a predetermined perimeter or boundary configuration.

2. References to Prior Art

There are no simple, lightweight, portable, and completely safe intrusion detection alarm systems for civilian and military use in the field. The most important example would be for backpacking and camping trips into remote settings, including military operations, such as army forays into enemy territory. In addition, there is significant need for intrusion detection alarms in protecting gardens and fruit trees, automobile and airplane displays, and comparable situations.

In the past, outdoor intrusion alarms have always used a plurality of cumbersome devices, straight-line trip lines, explosive charges, and inapplicable modern electronics, none of which can be easily transported and set up, and with the explosives, even legally carried on public transportation systems, such as the commercial airlines.

U.S. Pat. No. 1,434,132 to McDonald (1922) and U.S. Pat. No. 1,633,361 to Bryant (1927) are prime examples of the technology that has persisted almost until the present day. Both inventions use blank cartridges, which limit them to one-shot warnings, both are made of metal, which needs continuous maintenance to prevent rust and corrosion, as with a firearm, and, quite obviously, would drown out and fail in a rain storm or freeze and bust in the winter. Of greatest importance, however, both inventions are dangerous and could never be used around children, and some adults, for that matter.

U.S. Pat. No. 4,064,825 to Sly (1977) is a later example of the same methodology. Again, we are dealing with explosives, a cumbersome device, also the requirement for three alarms to secure a designated area, such as the campsite depicted in the patent drawings. All of this is prohibitive.

At this point, it is important to emphasize gunshot sounds, however they might be caused, are hazardous and should be avoided at all costs. Gunshots often elicit other gunshots, which could be from a law enforcement officer who has inadvertently stumbled into an alarm's trip line or a criminal who has done the same and thinks he is being shot at. Additionally, an interesting sidelight to this problem is the recent phenomenon of Alaskan brown bears coming on the run when they hear a gunshot. Many have learned that a shot means a deer or caribou has been killed by a hunter, and that they can take it away, since somehow they have come to understand they are protected by game regulations in this situation. What good is an alarm that could get someone killed?

U.S. Pat. No. 5,463,595 to Rodhall (1995) is a significant example of the modern technology that has become too large, heavy, and complex for everyday use. The system comprises a motion detector that triggers a variety of alarm generators, which include an automatic telephone dialer, clearly useless in a wilderness, and most rural areas as well. Most important, though, once more some pluralities of alarms are required to protect the perimeter of a monitored area, using the patent's own language to make the point that this invention is not simple, lightweight, or portable in a very profound way.

U.S. Pat. No. 5,892,446 to Reich (1999) is similar to the Rodhall invention, except that it uses infrared, along with a motion sensor. Once again, this invention uses technology that simply will not work in a wilderness or rural setting. It is made to install in a semipermanent way on a high wall, pole, or tree; needs a heavy 6-volt battery; and requires radio reception, which is not available in most remote parts of the country, especially at night. Also, the inventor did not anticipate the wind storms that always blow debris through protected spaces, let alone that a person must clear the brush and trees from a sizeable area to get it to work properly. Reich's wild animal deterrent device is not useful to most people, particularly those who are truly backpacking, camping, and exploring in the wild places of the world.

U.S. Pat. No. 6,118,375 to Duncan (2000) is an improved design for a portable intruder detection system, but the device is not practical when a person studies its actual usefulness. It is not truly small and lightweight when packaged with its remote control unit and twelve-foot telescopic pole with legs and support wires, and again requires its user to clear a large area so it can work properly. Most crucial, however, its space-age technology would never stand up to the punishment it would receive in the field. Hikers, backpackers, and campers constantly fall, throw their equipment on rocks, and get things wet. High technology is a curse in a wilderness, since there is no way to fix anything. Ideally, an outdoor intrusion detection alarm is almost indestructible and fits in a coat pocket.

Therefore, the objects and advantages of the present invention are:

1. It is simple and safe.
2. It is lightweight and portable.
3. One alarm protects an entire area, regardless of terrain and flora.
4. It is rugged and weatherproof.
5. It is repairable in the field.

Additional objects and advantages will become evident from an evaluation of the accompanying description and drawings.

SUMMARY OF THE INVENTION

My outdoor intrusion detection alarm is small, simple, and almost impervious, also can be easily carried, along with its power source and accessories, in a coat pocket or backpack pouch. It sets up quickly, is safe for children and adults alike, and emits a continuous warning sound when activated by an intruder, whether human or animal.

DESCRIPTION OF THE DRAWINGS

The invention is illustrated in the accompanying drawings, in which.

REFERENCE NUMBERS

Figure 2:
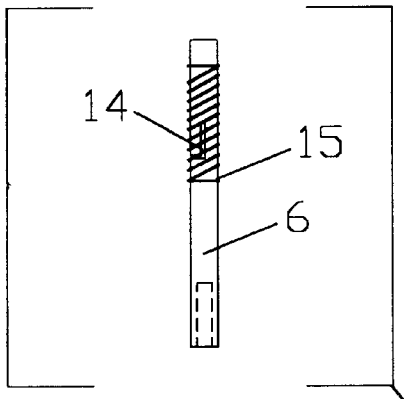
FIGS. 1 and 2 show exploded isometric views of the front.

1 portable housing
2 reel
3 sensor line
4 line hole
5 switch
6 augmenter
7 piezo siren
8 battery box
9 raceway
10 raceway ring
11 wiring
12 speaker mesh
13 handle
14 line shot
15 spring
16 terminal end
17 tab
18 battery cover
19 battery
20 fastener loops
21 housing fastener
22 line fastener
23 line guide

DETAILED DESCRIPTION OF THE INVENTION (PREFERRED EMBODIMENT)

Figure 1:
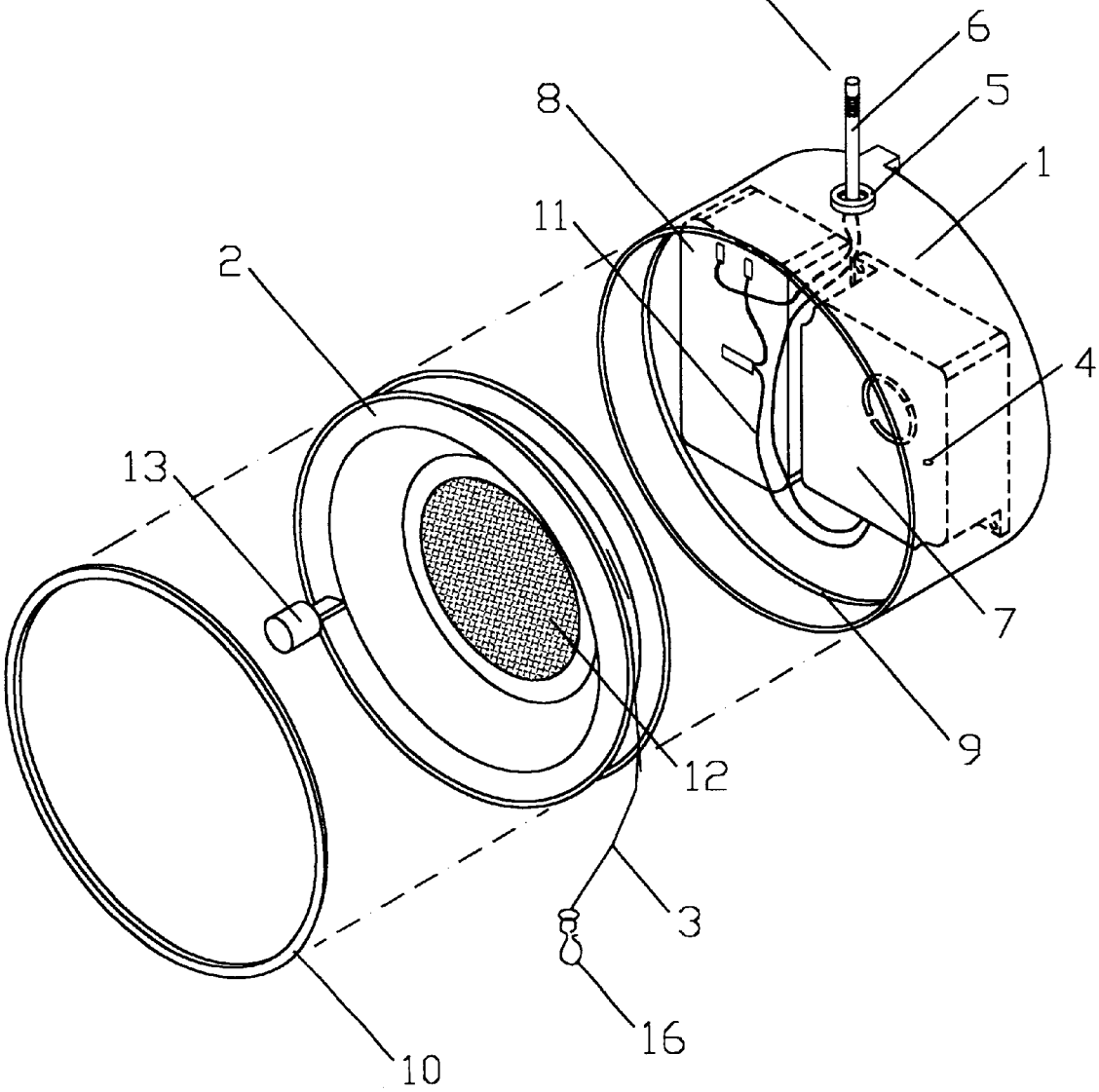
Figure 3:
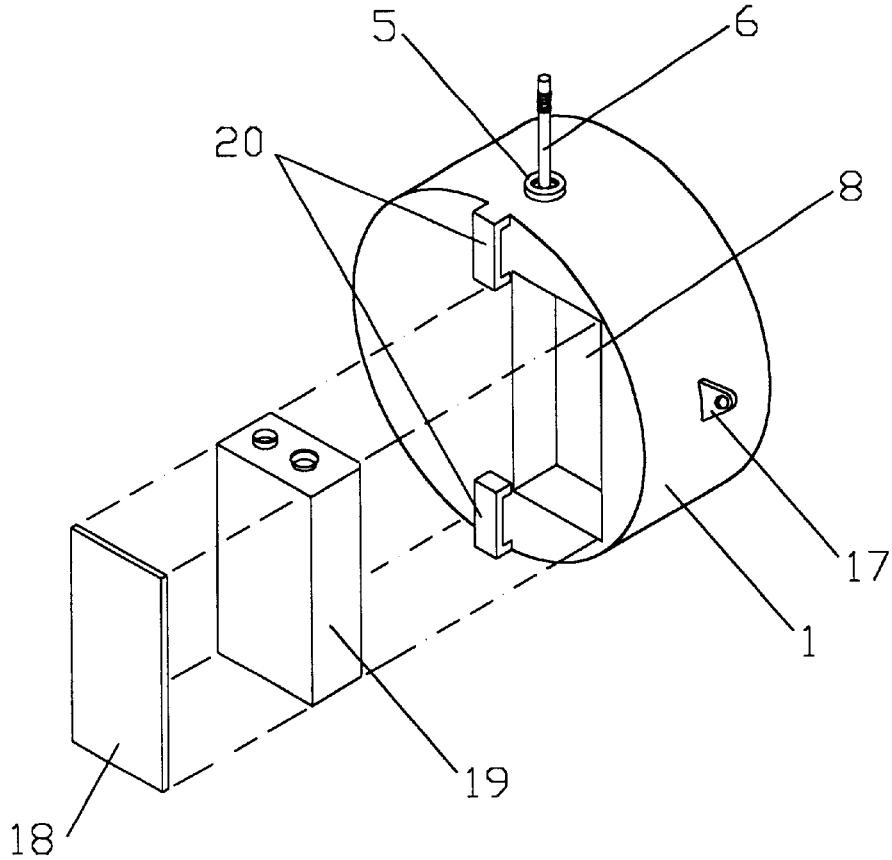
FIG. 3 shows an exploded isometric view of the back.

An outdoor intrusion detection system assembled in accordance with the present invention is shown in FIGS. 1 through 5. The preferred embodiment includes a portable housing 1 (FIGS. 1 and 3) that is a green or camouflage-colored plastic composite molding with a battery box 8 (FIGS. 1 and 3), a battery cover 18 (FIG. 3), two fastener loops 20 (FIG. 3), a tab 17 (FIG. 3), and a raceway 9 (FIG. 1). The portable housing 1 can also consist of alternative materials that can be glued, formed, or welded into the same approximate size and shape, between five and ten centimeters in diameter and three and six centimeters wide. There is a small hole, which is used for the installation of a switch 5 (FIGS. 1 and 3) in the top of the portable housing 1 when the tab 17 and the battery box 18 are on the right hand and the fastener loops 20 are vertical, as shown in FIG. 3. There is a much smaller hole, a line hole 4 (FIG. 1) when the portable housing 1 is viewed the other way, from its front.

A reel 2 (FIG. 1) with a handle 13 (FIG. 1), molded from plastic composites or similar materials as well, fits inside the portable housing 1 on the raceway 9 and is covered in its center with a speaker mesh 12 (FIG. 1). The reel 2 is wound with about 100 meters of a camouflaged, low-friction monofilament or fluorocarbon sensor line 3 (FIG. 1) that exits the line hole 4 to a terminal end 16 (FIG. 1). A raceway ring 10 (FIG. 1) hold the reel 2 in place.

Inside the portable housing 1 alongside the battery box 8 is a high-decibel piezo siren 7 (FIG. 1) with wiring 11 (FIG. 1) that leads to the switch 5, a single-pole, single-throw mini, and to the battery box 8. The switch 5 is held in place by a silicone rubber boot and metal nut fastener that protects it and the portable housing 1 from moisture. A 9-volt battery 19 (FIG. 3) and battery cover 18 snap into place below the switch 5, as illustrated in FIG. 3.

A five to ten centimeter lever or augmenter 6 (FIGS. 1, 2, and 3) with a spring 15 (FIG. 2) and a line slot 14 (FIG. 2) fits over the switch 5. The augmenter 6 has a hollow base and is designed to be attached to the switch 5 and the portable housing 1 as the system is being set up.

Figure 4:
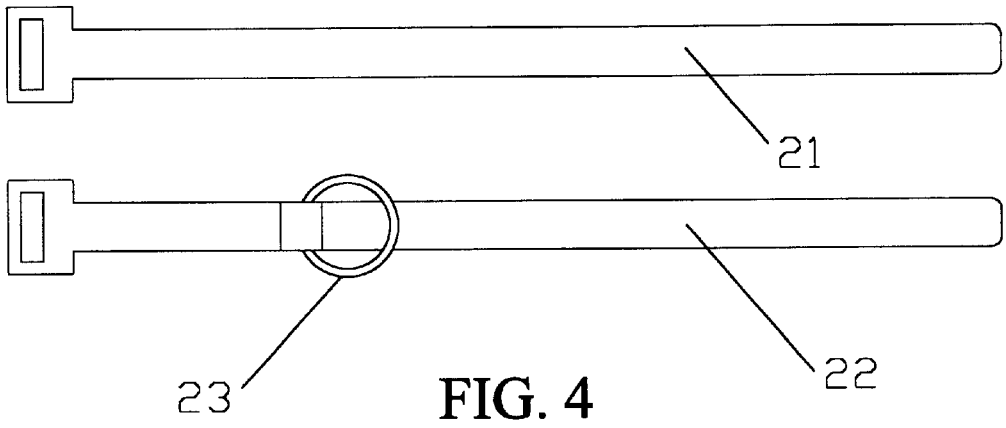
FIG. 4 shows two fasteners, one with a line guide.

FIG. 4 shows a housing fastener 21 and a line fastener 22 with an attached low-friction metal, teflon, or plasticized line guide 23 that provide the means for securing the portable housing 1 and the sensor line 3 to various natural objects, trees and bushes for example. These hook-and-loop fasteners are one to two centimeters wide and thirty to forty centimeters long, camouflage-colored as well, and can be fastened from end-to-end to fit almost anything, as illustrated in FIG. 5.

DETAILED DESCRIPTION OF THE INVENTION (OPERATION)

Figure 5:
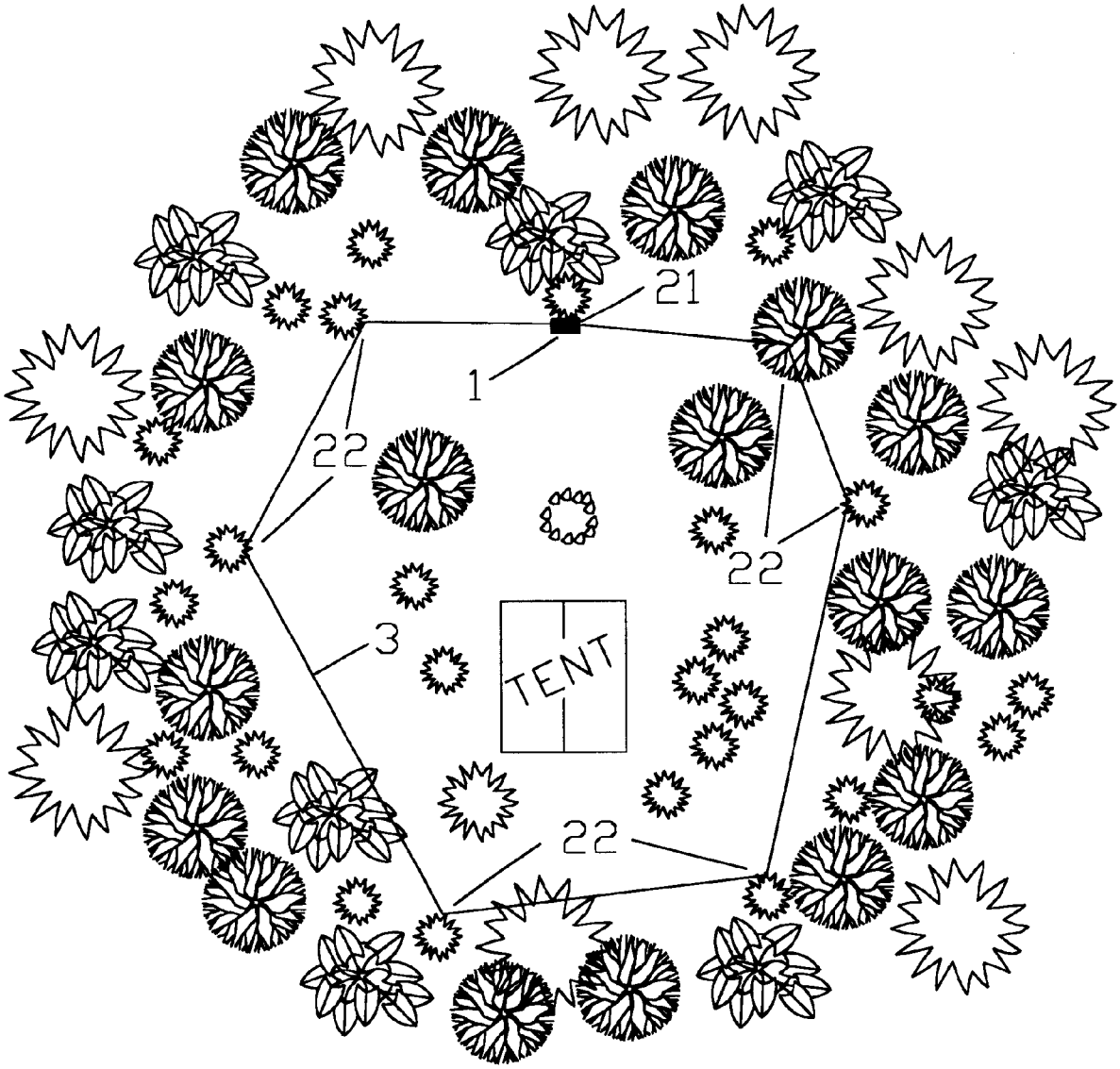
FIG. 5 shows an outdoor campsite.

The method of deploying the outdoor intrusion detection system shown in FIGS. 1 through 5 is simple, straightforward, and takes only minutes. The portable housing 1, as a complete assembly including two housing fasteners 20, a 9-volt battery 19, the battery cover 18, and the augmenter 6, is attached to a natural object such as a small tree in front of an area that needs monitoring, such as is shown in FIG. 5. Next, the terminal end 16 of the sensor line 3 is pulled out of the line hole 4, off the reel 2, and around a predetermined perimeter configuration or across a predetermined boundary configuration. As the sensor line 3 is pulled along, line fasteners 22 are attached to trees, brush, branches, or improvised tripods built from native materials, and sequentially threaded through the line guides 23, which should hang about one meter above the ground. When the sensor line 3 has been completely strung, it is hooked to the tab 17 or onto itself around a distant object.

Once the sensor line is set up, a short length of slack is pulled out the line hole 4 and fitted into the line slot 14 by depressing the spring 15 on the augmenter 6 that sits on the switch 5. The augumenter 6 can be pulled off the switch 5 for the purposes of installation and/or adjustments of the sensor line 3, then reinstalled by pressing it back down. This permits the sensor line 3 to be set from sensitive to somewhat loose, which would be preferable if the sensor line 3 were running through trees and brush swaying back and forth in stormy winds, weather the present invention contemplated when designed. The sensor line 3 is spidery in texture and appearance, almost weightless, and so frictionless that it can be strung through flora without losing its ability to detect an intruder, though it might be rubbing against bark, weeds, or grass. An additional feature is that stringing it approximately one meter above the ground detects all intruders that are potentially dangerous, bears, mountain lions, and humans, yet lets the smaller, harmless animals, like rabbits and raccoons come and go without triggering a false alarm.

After the detection system is in place, the terminal end 16 of the sensor line 3 is pulled to test the battery 19 is fully charged and will power the piezo siren 7 and send an alarm signal through the speaker mesh 12 inside the reel 2. This will also demonstrate the sensor line 3 is correctly aligned with the augmenter 6 and switch 5, which sets off a high-decibel scream greater than the sound of a home smoke alarm.

When it is time to disassemble the detection system, the terminal end 16 is unhooked and the reel 2 winds up the sensor line 3 through the line hole 4 with the handle 13. The reel 2 spins between the raceway 9 inside the portable housing 1 and the raceway ring 10 that keeps it in place. Afterwards, the line fasteners 22 are retrieved, the housing fasteners 21 pulled free of the fastener loops, the augmenter 6 removed, and then everything rolled into a round shape about the size of a baseball weighing only a few ounces.

DETAILED DESCRIPTION OF THE INVENTION (CONCLUSION, RAMIFICATIONS, AND SCOPE)

An evaluation of the invention will establish that it provides a simple, lightweight, and highly reliable intrusion alarm useful to almost everyone. A summary of its distinct advantages include the following:

1. It sets up in a few minutes.
2. It works in all terrain and flora conditions.
3. It is easily adjustable to different kinds of intruders and weather.
4. It is rugged, compact, and weighs only ounces with battery and fasteners.
5. It can be hand-carried and used as a personal alarm and/or when a person is lost.
6. Its components can be used for survival in a wilderness disaster: the sensor line and terminal end for fishing and the fasteners for building a shelter, for two examples.
7. Replacement parts can be bought at stores like RadioShack and Wal-Mart.
8. It is usable in and out of the home, in gardening, and around the farm, in addition to hiking, camping, etc.
9. It is affordable.

Though the previous description includes many specificities, these are only meant to be illustrative and are not intended to limit the scope of the invention, but instead to act as an exemplification of a preferred embodiment of it. Other variations are possible. There are various ways to construct and assemble the present invention by using different materials and components, with the sensor line 3 and line fasteners 21 and 22, for example. Dacron, floss, mylar, nylon, and an assortment of impregnated and plasticized threads could be used, along with miniature pulleys, so long as a nearly frictionless combination was copied. In addition, the switch and augmentation could be changed by substituting a lever, magnetic, rotary, or snap-action switch, or by mounting the switching device horizontally, instead of vertically. Therefore, it should be understood that various modifications and adaptations of the present invention and alternative embodiments of it may be contemplated. The scope of the invention should be determined not by the embodiments shown, but by the appended claims and legal equivalents.

The embodiments of the invention being claimed as an exclusive property or privilege are defined as follows:

1. A portable outdoor intrusion detection system for protecting human lives and/or property within a predetermined perimeter configuration or a predetermined boundary configuration, said system comprising:

a portable housing;

a sensor line for sensing human and/or animal intrusions into said predetermined perimeter or boundary configurations and that activates a detection signal when said intrusions occur;

a storage reel for releasing, retrieving, and storing said sensor line;

an augmented switch;

a power supply for powering said detection signal; and a plurality of adjustable fasteners providing a means for adjusting the horizontal and/or vertical positions of said portable housing and said sensor line so that said housing and sensor line are positioned into the predetermined perimeter or boundary configuration.

2. A portable outdoor intrusion detection system according to claim 1, wherein said augmented switch provides a means for sensitivity adjustments for human and/or animal intrusion detection.

3. A portable outdoor intrusion detection system according to claim 1, wherein said adjustable fasteners provide a means for sensitivity adjustments for said sensor for human and/or animal intrusion detection.

4. A portable outdoor intrusion detection system according to claim 1, wherein said adjustable fasteners provide a means for a variable perimeter configuration or a variable boundary configuration in conformity with terrain and/or flora.

5. A portable outdoor intrusion detection system according to claim 1, wherein said detection signal comprises a high decibel audio warning.

* * * * *